US010244309B2

(12) United States Patent
Kobayashi

(10) Patent No.: US 10,244,309 B2
(45) Date of Patent: Mar. 26, 2019

(54) SPEAKER SYSTEM AND ELECTRONIC DEVICE USING SAME

(71) Applicant: Panasonic Intellectual Property Management Co., Ltd., Osaka (JP)

(72) Inventor: Yuichi Kobayashi, Okayama (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 120 days.

(21) Appl. No.: 15/324,005

(22) PCT Filed: Jun. 24, 2015

(86) PCT No.: PCT/JP2015/003166
§ 371 (c)(1),
(2) Date: Jan. 5, 2017

(87) PCT Pub. No.: WO2016/021106
PCT Pub. Date: Feb. 11, 2016

(65) Prior Publication Data

US 2017/0208388 A1 Jul. 20, 2017

(30) Foreign Application Priority Data

Aug. 4, 2014 (JP) ..... 2014-158317

(51) Int. Cl.
*H04R 1/42* (2006.01)
*H04R 1/28* (2006.01)
(Continued)

(52) U.S. Cl.
CPC ..... *H04R 1/2819* (2013.01); *H04R 1/021* (2013.01); *H04R 1/2803* (2013.01); *H04R 1/42* (2013.01); *H04R 9/06* (2013.01); *H04R 2499/11* (2013.01)

(58) Field of Classification Search
CPC ..... H04R 1/2803; H04R 1/42
(Continued)

(56) References Cited

U.S. PATENT DOCUMENTS 8,265,330 B2 * 9/2012 Fukunishi ..... H04R 1/2803 381/386
8,794,373 B1 * 8/2014 Lin ..... B01D 53/0407 181/151
(Continued)

FOREIGN PATENT DOCUMENTS

CN 101027935 A 8/2007
JP 9-067749 3/1997
(Continued)

OTHER PUBLICATIONS

International Search Report of PCT application No. PCT/JP2015/003166 dated Sep. 15, 2015.
(Continued)

*Primary Examiner* — Jeremy A Luks
(74) *Attorney, Agent, or Firm* — McDermott Will & Emery LLP

(57) ABSTRACT

A speaker system includes an enclosure, a speaker unit, and an elastic sheet. The speaker unit is disposed in the enclosure. The elastic sheet includes a first fiber made of a resin and a second fiber made of a resin, and is disposed in the enclosure. The second fiber is thicker than the first fiber and entangled with the first fiber.

12 Claims, 7 Drawing Sheets

(51) Int. Cl.
*H04R 1/02* (2006.01)
*H04R 9/06* (2006.01)

(58) Field of Classification Search
USPC ..... 181/151; 381/352, 354
See application file for complete search history.

(56) References Cited

U.S. PATENT DOCUMENTS

| | | | | |
|---|---|---|---|---|
| 9,033,158 | B2 * | 5/2015 | Yoshinobu | C02F 1/283 210/435 |
| 2007/0195982 | A1 | 8/2007 | Saiki et al. | |
| 2009/0120715 | A1 | 5/2009 | Saiki | |
| 2009/0245562 | A1 * | 10/2009 | Saiki | H04R 1/2803 381/345 |

FOREIGN PATENT DOCUMENTS

| | | |
|---|---|---|
| JP | 2008-042948 | 2/2008 |
| JP | 2008-252908 | 10/2008 |

OTHER PUBLICATIONS

English Translation of Chinese Search Report dated Sep. 20, 2018 for the related Chinese Patent Application No. 201580034168.7.

* cited by examiner

SPEAKER SYSTEM AND ELECTRONIC DEVICE USING SAME

This application is a U.S. national stage application of the PCT international application No. PCT/JP2015/003166.

TECHNICAL FIELD

The present disclosure relates to a speaker system in which a speaker unit is housed in an enclosure, and an electronic device using the speaker system.

BACKGROUND ART

Hereinafter, a conventional speaker system is described. A conventional speaker system includes an enclosure (cabinet), a speaker unit, and an activated carbon elastic sheet. The enclosure has an air gap inside thereof. The speaker unit and the activated carbon elastic sheet are housed in the air gap. As the activated carbon elastic sheet, an activated carbon fiber layer obtained by forming activated carbon into a sheet-shaped (rectangular parallelepiped shaped) lump is used.

Activated carbon has extremely many fine pores. The fine pores improve a sound pressure level of a low sound. However, when the fine pores of the activated carbon adsorb water vapor, the sound pressure level of a low sound is reduced. Thus, in order to suppress moisture absorption by activated carbon, a method for forming a resin-impregnated layer by impregnating the front and back sides of the activated carbon fiber layer with a moisture-resistant resin, has been thought. That is to say, an activated carbon elastic sheet having a structure in which an activated carbon fiber layer (activated carbon) is sandwiched between resin-impregnated layers (activated carbon which has been impregnated with resin) is used.

Note here that information on prior art documents relating to the invention of this application include, for example, PTL 1.

CITATION LIST

Patent Literature

PTL 1: Japanese Patent Application Unexamined Publication No. 2008-252908

SUMMARY OF THE INVENTION

A speaker system of the present disclosure includes an enclosure, a speaker unit, and an elastic sheet. The speaker unit is disposed in the enclosure. The elastic sheet includes a first fiber made of a resin and a second fiber made of a resin, and is disposed in the enclosure. The second fiber is thicker than the first fiber and entangled with the first fiber.

Furthermore, an electronic device of the present disclosure includes a case, a speaker system of the present disclosure, and a processing circuit. The speaker system is housed in the case. The processing circuit is electrically connected to the speaker system.

DESCRIPTION OF EMBODIMENTS

In a conventional speaker system, fine pores of activated carbon contribute to improvement of a sound pressure level of a low sound. However, the fine pores at the front and back sides of the activated carbon fiber layer are closed by a resin. Therefore, the fine pores of activated carbon are exposed to only the side surfaces of the activated carbon fiber layer. Therefore, in a conventional speaker system, in order to excellently reproduce a sound in a low sound range, it is necessary to increase an amount of the activated carbon elastic sheet to be packed in an enclosure and to increase the surface area of the side surfaces of the activated carbon fiber layer. Accordingly, it is necessary to increase the capacity of an air gap in the enclosure.

Hereinafter, a speaker system in accordance with this exemplary embodiment is described. In recent years, small electronic devices in which a speaker system is installed have been developed. Among them, portable devices such as a tablet terminal and a smartphone are required to be small in size in order to be easily carried. Therefore, in speaker systems to be installed in such electronic devices, a small speaker unit is required to be housed in a small enclosure. Furthermore, on the other hand, an electronic device capable of providing moving picture and the like along with a beautiful sound has been demanded.

Under such circumstances, a speaker system to be installed in an electronic device is required to have a small size and be able to reproduce sounds in a wide sound range. In general, a sound pressure level of a speaker unit is smaller in a low sound range as compared with in a high sound range. Thus, in a small speaker unit, in order to reproduce sounds in a wide sound range, it is necessary to improve sound pressure frequency characteristics in the low sound range of the speaker system. Therefore, a conventional speaker system needs an air gap having a large volume inside an enclosure. The speaker system of the present disclosure can increase a sound pressure level in a low sound range although the enclosure has a small volume.

First Exemplary Embodiment

Figure 1:
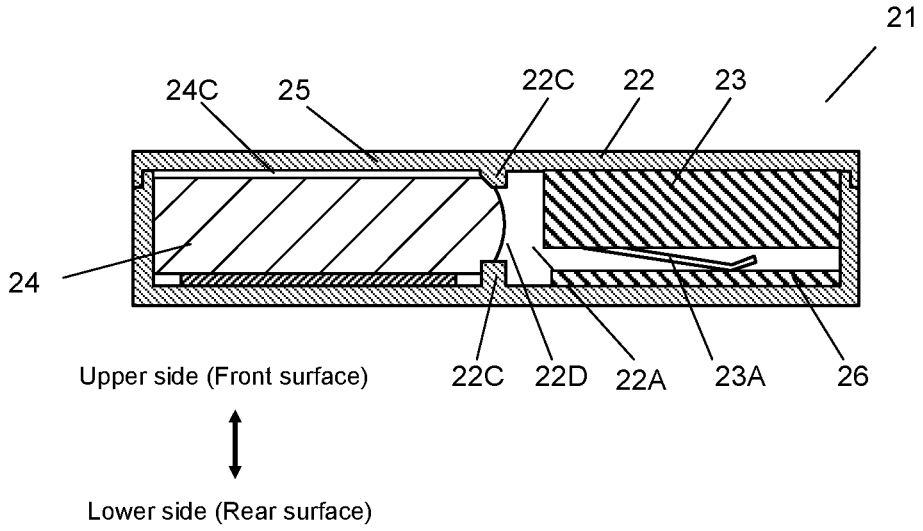
FIG. 1 is a sectional view of a speaker system in accordance with an exemplary embodiment.
Figure 2:
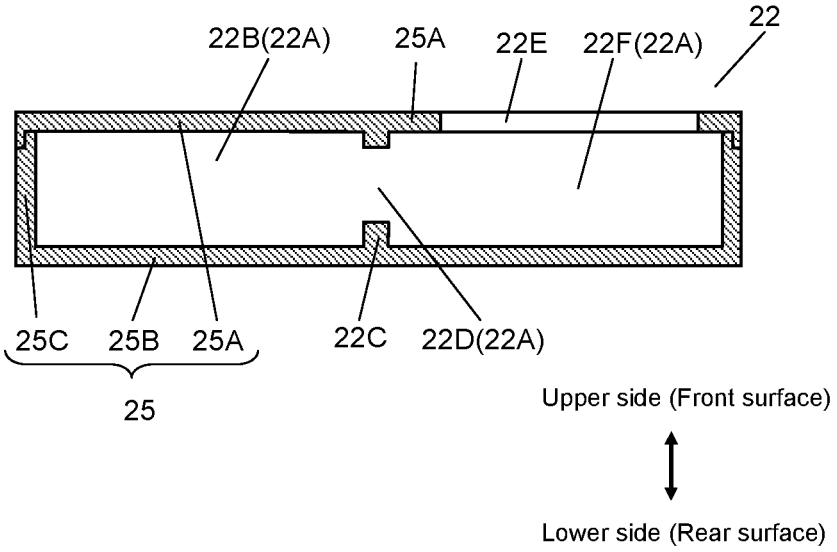
FIG. 2 is a sectional view of an enclosure in accordance with this exemplary embodiment.

FIG. 1 is a sectional view of speaker system 21 in accordance with an exemplary embodiment. FIG. 2 is a sectional view of enclosure 22 in accordance with this exemplary embodiment. Speaker system 21 of the present disclosure includes enclosure 22, speaker unit 23, and elastic sheet 24. Speaker unit 23 is disposed in enclosure 22. Elastic sheet 24 includes first fiber 24A made of a resin and second fiber made 24E made of a resin. Elastic sheet 24 is disposed in enclosure 22. Second fiber 24E is thicker than first fiber 24A, and entangled with first fiber 24A.

Hereinafter, speaker system 21 is described in detail. Speaker system 21 includes enclosure 22 having air gap 22A inside thereof, speaker unit 23, and elastic sheet 24. Elastic sheet 24 is disposed in housing space 22B of air gap 22A of enclosure 22. Speaker unit 23 is disposed in speaker space 22F of air gap 22A of enclosure 22.

Enclosure 22 (cabinet) has wall surfaces 25. Wall surfaces 25 include upper wall surface 25A, lower wall surface 25B, and side wall surface 25C. Upper wall surface 25A, lower wall surface 25B, and side wall surface 25C surround air gap 22A. Enclosure 22 has sound emitting hole 22E. Sound emitting hole 22E penetrates through upper wall surface 25A of enclosure 22. Sound emitting hole 22E links air gap 22A to the outside of enclosure 22. It is preferable that sound emitting hole 22E is formed in wall surface 25 surrounding speaker space 22F. Note here that in FIGS. 1 and 2, wall surface 25 having sound emitting hole 22E is defined as an upper side (front surface), and its opposite side is defined as a lower side (rear surface). However, the configuration is not limited to this alone, and sound emitting hole 22E may be formed in any other wall surfaces 25.

Speaker unit 23 is housed in enclosure 22 such that a sound output from speaker unit 23 can be output from sound emitting hole 22E.

Figure 3A:
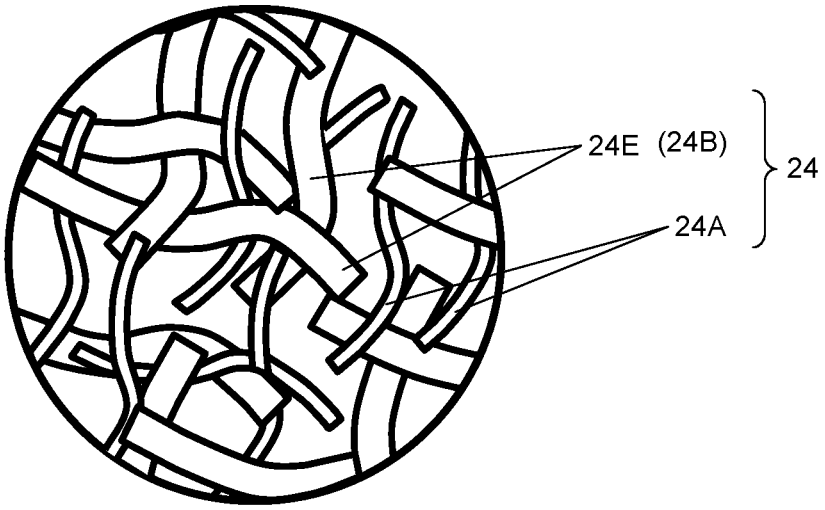
FIG. 3A is a conceptual diagram of an elastic sheet in accordance with this exemplary embodiment.

FIG. 3A is a conceptual diagram of elastic sheet 24 in accordance with this exemplary embodiment. The elastic sheet includes first fiber 24A and elastic member 24B. First fiber 24A is made of a resin. First fiber 24A has a first diameter. Elastic member 24B is formed of second fiber 24E made of resin. Second fiber 24E has a second diameter thicker than the diameter of the first fiber. Furthermore, second fibers 24E are entangled with first fibers 24A.

Elastic sheet 24 includes first fibers 24A each having a thin diameter, and has a large number of gaps. Consequently, speaker system 21 shown in FIG. 1 can improve a sound pressure level in a low sound range. Therefore, elastic sheet 24 has an effect of pseudo-expanding a volume of air gap 22A of enclosure 22 (hereinafter, referred to as a "volume expansion effect"). That is to say, elastic sheet 24 functions as a member for pseudo-expanding the volume (hereinafter, referred to as a "volume expansion member") of enclosure 22.

Herein, the volume expansion effect does not mean that a volume of enclosure 22 actually expands. Conventionally, in order to improve a sound pressure level in a low sound range, it has been necessary to expand the volume of enclosure 22. However, speaker system 21 of the present disclosure has the same effect as an effect of pseudo-expanding the volume of enclosure 22 without expanding volume of enclosure 22.

Herein, in a case where elastic sheet 24 is formed of only first fibers 24A, when first fibers 24A are compressed and packed, most gaps in first fibers 24A are lost. Therefore, when elastic sheet 24 is formed of only first fibers 24A, in order to secure predetermined gaps, the size of enclosure 22 needs to be large to some degree. However, elastic sheet 24 of the present disclosure includes second fibers 24E each having a thick fiber diameter. Consequently, even when elastic sheet 24 is compressed and packed in enclosure 22, gaps between fibers can be secured. Therefore, a large amount of elastic sheet 24 can be compressed and packed in small air gap 22. That is to say, a large amount of elastic sheet 24 can be packed in enclosure 22 without using a large enclosure 22. Thus, the sound pressure level in the low sound range can be improved with small speaker system 21.

Hereinafter, speaker system 21 is described in more detail. Speaker unit 23 includes a frame, a diaphragm, a voice coil body, and a magnetic circuit including a magnetic gap (not shown). The magnetic circuit is housed in the frame, and bonded to the frame. The outer periphery of the diaphragm is coupled to the frame. A first end portion of the voice coil body is bonded to the diaphragm. On the other hand, a second end portion of the voice coil body is disposed in the magnetic gap.

As shown in FIG. 1, speaker unit 23 includes a front surface for outputting a sound and a rear surface provided with terminal 23A. Speaker unit 23 is supplied with an audio signal from terminal 23A, so that a sound is emitted. Note here that the front surface of speaker unit 23 is disposed in contact with upper wall surface 25A.

Wiring board 26 is housed in enclosure 22. Wiring board 26 is disposed to speaker unit 23 at a rear surface side. Terminal 23A is electrically connected to a voice coil. Terminal 23A is pressed to wiring board 26 with elastic force. With this configuration, the front surface of speaker unit 23 is pressed against upper wall surface 25A.

Enclosure 22 has housing space 22B in a place other than space in which speaker unit 23 is disposed (speaker space 22F). Furthermore, it is preferable that enclosure 22 includes air-permeable portion 22D. Note here that it is preferable that air-permeable portion 22D is formed in a surface that is not in contact with wall surface 25. That is to say, it is preferable that housing space 22B and speaker space 22F are linked to each other via air-permeable portion 22D. For example, air-permeable portion 22D is formed such that it is adjacent to speaker unit 23. Elastic sheet 24 is housed in housing space 22B. With this configuration, a sound output from the rear surface of speaker unit 23 can enter housing space 22B via air-permeable portion 22D. Note here that housing space 22B may be disposed in one place or in two or more places. Alternatively, housing space 22B may be composed of a plurality of housing spaces.

It is preferable that enclosure 22 includes projection 22C. In this case, housing space 22B is formed such that it is surrounded by upper wall surface 25A, lower wall surface 25B, side wall surface 25C, and projection 22C. Furthermore, air-permeable portion 22D is formed between projections 22C. This configuration suppresses movement of elastic sheet 24 inside enclosure 22. Note here that projection 22C may not be provided. In this case, housing space 22B is surrounded by upper wall surface 25A, lower wall surface 25B, side wall surface 25C, and one side surface of speaker unit 23.

It is preferable that lower wall surface 25B and side wall surfaces 25C are formed unitarily with each other. Furthermore, upper wall surface 25A and side wall surfaces 25C may be formed unitarily with each other. In these cases, man-hours for assembling enclosure 22 are reduced. Furthermore, since elastic sheet 24 can be packed in box-like enclosure 22, elastic sheet 24 can be restrained from projecting to the outside of enclosure 22 when enclosure 22 is lidded. Therefore, the man-hours for assembling enclosure 22 are reduced. Note here that a part of side wall surface 25C may be formed unitarily with upper wall surface 25A, and remaining side wall surface 25C may be formed unitarily with lower wall surface 25B. Furthermore, side wall surface 25C may have a double structure.

Next, the detail of elastic sheet 24 is described with reference to FIG. 3A.

It is preferable that first fiber 24A is made of a thermoplastic resin. As first fiber 24A, for example, polypropylene is used. It is preferable that a diameter of first fiber 24A is thinner than that of second fiber 24E. When a thinner-diameter fiber and a thicker-diameter fiber are compared with each other, a surface area of the thinner-diameter fiber is larger than that of the thicker-diameter fiber when the both fibers have the same weight. Consequently, use of thin first fiber 24A can increase the contact area between the fiber and air inside enclosure 22. That is to say, since elastic sheet 24 includes first fiber 24A having a thinner diameter, a value of the volume expansion effect can be increased.

Note here that the diameter of first fiber 24A is preferably 4 μm or less. This configuration can increase the value of the volume expansion effect by elastic sheet 24. Furthermore, the diameter of first fiber 24A is preferably 1 μm or more. This configuration enhances the productivity of first fiber 24A. Furthermore, first fiber 24A may include a fiber having a diameter of 0.3 μm or more. Alternatively, the diameter of first fiber 24A may be 0.3 μm or more and less than 1 μm. In this way, including of thin fibers can further increase the value of the volume expansion effect by elastic sheet 24. The value of the volume expansion effect by elastic sheet 24 can be increased.

It is preferable that second fiber 24E is made of a thermoplastic resin. As second fiber 24E, for example, polypropylene is used. The diameter of second fiber 24E is preferably 20 μm or more and 30 μm or less. This configuration allows second fiber 24E to have elasticity. Note here that second fiber 24E may surround a lump made of only first fibers 24A. That is to say, second fibers 24E may cover the surface of the lump made of only first fibers 24A. In this case, a portion in which first fiber 24A and second fiber 24E are entangled with each other is a surface part of the lump of first fibers 24A.

Figure 3B:
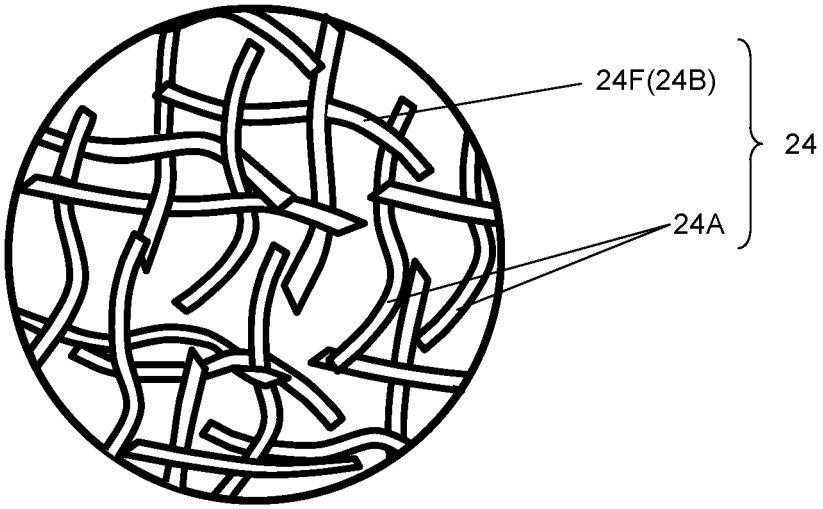
FIG. 3B is a conceptual diagram of another elastic sheet in accordance with this exemplary embodiment.

Note here that elastic member 24B is formed of second fiber 24E, but the configuration is not necessarily limited to this. FIG. 3B is a conceptual diagram of another elastic sheet in accordance with this exemplary embodiment. For elastic member 24B, third fiber 24F having the same thickness as that of first fiber 24A and the same elasticity as that of second fiber 24E may be used. In other words, a value of tensile modulus of elasticity of third fiber 24F is higher than that of first fiber 24A. A material for third fiber 24F may be appropriately selected from materials such as engineering plastic having high strength. Furthermore, as shown in FIG. 3C, elastic member 24B may include second fiber 24E and third fiber 24F.

Figure 3C:
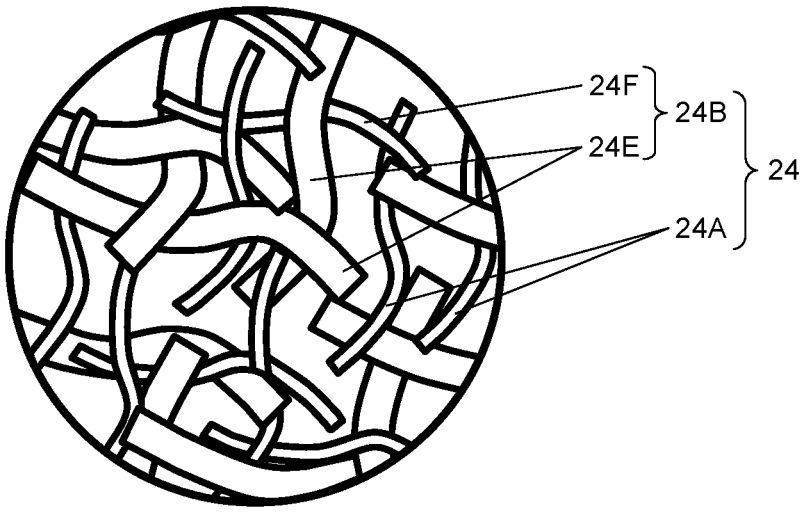
FIG. 3C is a conceptual diagram of still another elastic sheet in accordance with this exemplary embodiment.

Note here that in the configurations of FIGS. 3A to 3C, as first fiber 24A, nanofiber may be included. The diameter of first fiber 24A in this case is preferably 300 nanometers or more. In this way, use of such an extremely thin fiber can further increase the value of the volume expansion effect by elastic sheet 24. Furthermore, use of only nanofibers makes gaps in the fibers collapse when the nanofibers are packed in the enclosure. As a result, when the amount of the nanofibers to be packed is too large, the volume expansion effect is suddenly reduced. However, since elastic sheet 24 includes second fibers 24E, even when nanofibers are used as first fibers 24A, collapse of elastic sheet 24 is suppressed.

Next, the relation between the volume expansion member to be packed in the enclosure and weight is described. Samples of Example 1, and Comparative Examples 1 and 2 in which different volume expansion members are placed in the enclosure are produced. Then, the volume expansion effects of the samples are measured. Note here that in all of Example 1, and Comparative Examples 1 and 2, the volume of the enclosure is 1 $cm^3$.

Example 1

Elastic sheet 24, as a volume expansion member, is packed in an enclosure.

Comparative Example 1

An activated carbon elastic sheet, as a volume expansion member, is packed in an enclosure.

Comparative Example 2

Felt, as a volume expansion member, is packed in an enclosure.

Figure 4:
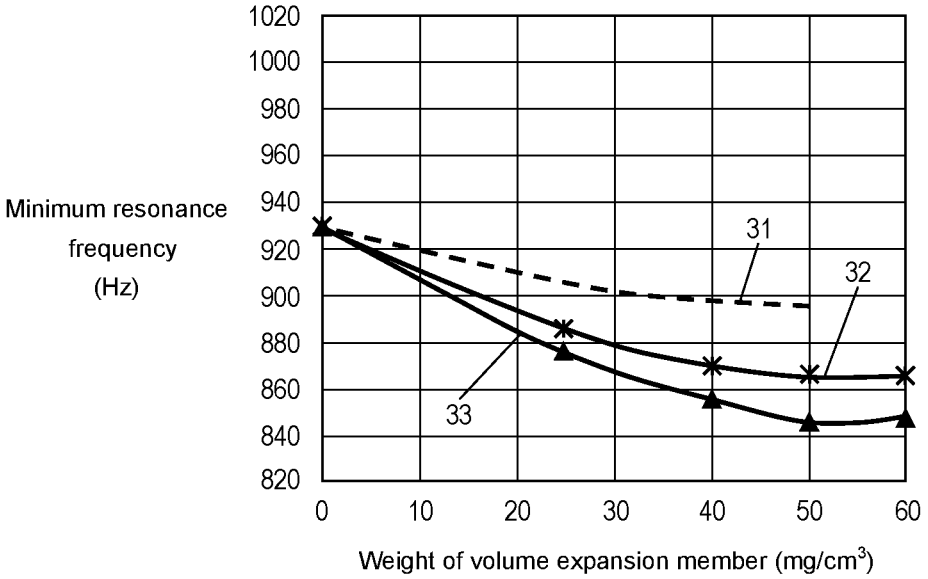
FIG. 4 is a characteristic diagram showing a minimum resonance frequency of the speaker system in accordance with this exemplary embodiment.

FIG. 4 is a characteristic diagram showing a minimum resonance frequency of speaker system 21 in accordance with this exemplary embodiment. FIG. 4 shows values of the minimum resonance frequency of Example 1, and Comparative Examples 1 and 2. The abscissa shows the weight per unit volume of the volume expansion member housed in the enclosure. The ordinate shows the value of the minimum resonance frequency. According to Japanese Industrial Standards, the minimum resonance frequency is defined as the lowest frequency among the frequencies in which an absolute value of the electric impedance of a voice coil is a maximum. The value of the minimum resonance frequency is measured by using an apparatus capable of measuring impedance for each frequency. The following measurement values are measured by using ES-1 Audio Generator (manufactured by Etani Electronics Co., Ltd.). In FIG. 4, characteristic curve 31 shows a case where an activated carbon elastic sheet is used as the volume expansion member (Comparative Example 1). Characteristic curve 32 shows a case where felt is used as the volume expansion member (Comparative Example 2). Characteristic curve 33 shows a case where elastic sheet 24 is used as the volume expansion member (Example 1).

Figure 5:
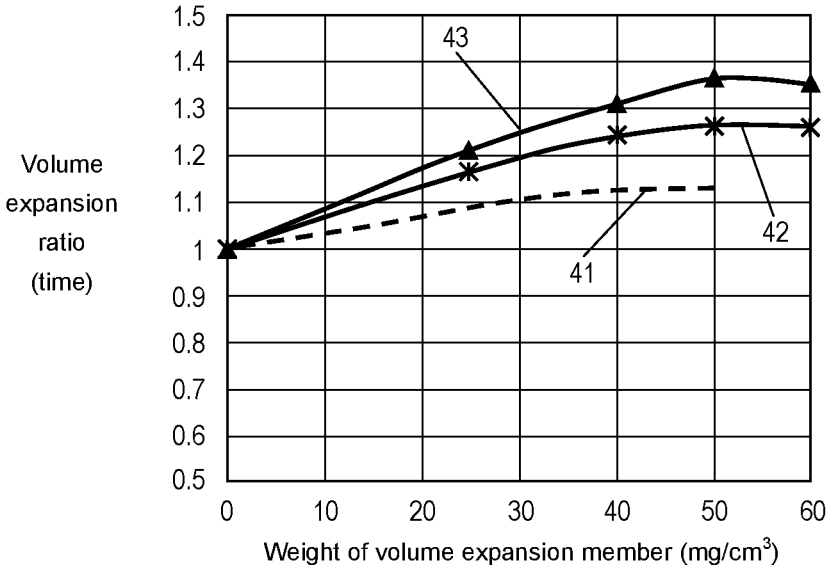
FIG. 5 is a characteristic diagram for illustrating a volume expansion effect of the speaker system in accordance with this exemplary embodiment.

FIG. 5 is a characteristic diagram for illustrating a volume expansion effect of speaker system 21 in accordance with this exemplary embodiment. FIG. 5 shows volume expansion effects of Example 1, and Comparative Examples 1 and 2. The abscissa shows the weight per unit volume of the volume expansion member housed in the enclosure (hereinafter, simply referred to as "weight"). The ordinate shows the volume expansion ratio. That is to say, FIG. 5 shows relation between the weight of the volume expansion member and the volume expansion effect. The volume expansion ratio denotes a ratio of a minimum resonance frequency (A) to a minimum resonance frequency (B), where (A) is a minimum resonance frequency when the volume expansion member is housed in the enclosure, and (B) is a minimum resonance frequency when the weight of the volume expansion member in the enclosure is 0 mg. That is to say, the value of the volume expansion ratio is calculated by dividing the value of (B) by the value of (A). The value of volume expansion ratio when nothing is housed in the enclosure is 1. The volume expansion ratio represents pseudo-expansion ratio of the volume of the enclosure by a material housed in the enclosure. The larger the value of the volume expansion ratio is, the larger the effect of the volume expansion member is.

Characteristic curve 41 shows relation between the weight of an activated carbon elastic sheet and the volume expansion ratio (Comparative Example 1). Characteristic curve 42 shows relation between the weight of felt and the volume expansion ratio (Comparative Example 2). Characteristic curve 43 shows relation between the weight of elastic sheet 24 and the volume expansion ratio (Example 1). As shown in FIG. 5, the volume expansion effect of the volume expansion member in Example 1 becomes maximum when the weight is 50 mg/cm3. Furthermore, in comparison when the weight of the volume expansion member is the same, the volume expansion effect of elastic sheet 24 is the largest in every weight.

Furthermore, as shown in characteristic curve 42, the value of the volume expansion effect of felt is saturated at 50 mg/cm$^3$ or more. The value of the volume expansion effect in this case is about 1.25. On the other hand, the value of the volume expansion effect of elastic sheet 24 is about 1.25 at 30 mg/cm$^3$. That is to say, the value of the volume expansion effect when 30 mg/cm$^3$ of elastic sheet 24 is placed and the value of the volume expansion effect when 50 mg/cm$^3$ of felt is placed are substantially the same as each other. Therefore, it is preferable that 30 mg/cm$^3$ or more of elastic sheet 24 is packed. That is to say, the volume expansion effect can be increased when more than 30 mg/cm$^3$ of elastic sheet 24 is packed as compared with the case where the larger weight of felt or activated carbon elastic sheet is packed.

As shown in characteristic curve 43, the value of the volume expansion effect of elastic sheet 24 is about 1.3 at 40 mg/cm$^3$. That is to say, an enclosure when the volume expansion member is not placed needs 30% larger volume as compared with the case where elastic sheet 24 is placed. On the contrary, when elastic sheet 24 is placed, the volume of the enclosure can be reduced by about 30% as compared with the case where the volume expansion member is not placed.

Note here that the value of the volume expansion effect when about 30 mg/cm$^3$ of elastic sheet 24 is placed and the value when about 50 mg/cm$^3$ of felt is placed are substantially the same as each other. Therefore, it is preferable that 30 mg/cm$^3$ or more, preferably 40 mg/cm$^3$ or more of elastic sheet 24 is packed. This configuration can increase the volume expansion effect as compared with the case of felt. Furthermore, when 50 mg/cm$^3$ or more of elastic sheet 24 is packed, the value of the volume expansion effect becomes smaller. Thus, it is preferable that 60 mg/cm$^3$ or less of elastic sheet 24 is packed.

Next, samples of Example 2 and Comparative Examples 3 and 4 are produced. For each enclosure, 50 mg/cm$^3$ each of different volume expansion members is placed. Furthermore, a sample of Comparative Example 5 in which the volume expansion member is not placed in the enclosure is also produced. Then, frequency characteristics of the samples are measured. Note here that volumes of the enclosures in Example 2, and Comparative Examples 3, 4, and 5 are all 1 cm$^3$.

Example 2

Elastic sheet 24, as the volume expansion member, is packed in the enclosure.

Comparative Example 3

An activated carbon elastic sheet, as the volume expansion member, is packed in the enclosure.

Comparative Example 4

Felt, as the volume expansion member, is packed in the enclosure.

Comparative Example 5

A volume expansion member is not housed in the enclosure.

Figure 6:
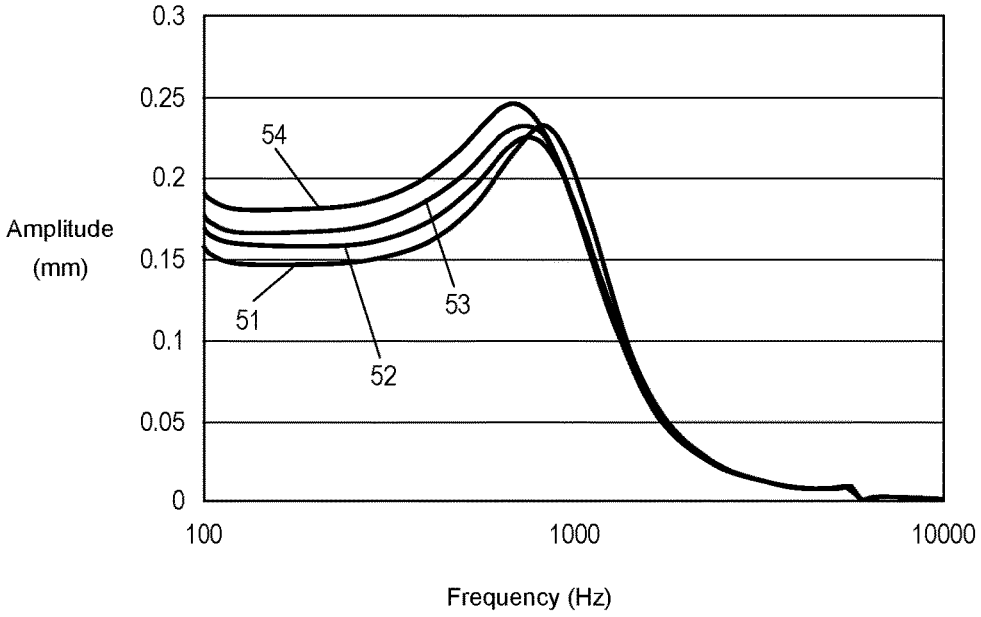
FIG. 6 is a characteristic diagram showing an amplitude of a diaphragm of the speaker system in accordance with this exemplary embodiment.

FIG. 6 is a characteristic diagram showing an amplitude of a diaphragm of speaker system 21 in accordance with this exemplary embodiment. FIG. 6 shows amplitude characteristics of Example 2 and Comparative Examples 3, 4, and 5, respectively. The abscissa shows the frequency, and the ordinate shows the value of an amplitude of a diaphragm. That is to say, FIG. 6 shows relation between the frequency and the amplitude of the diaphragm. Characteristic curve 51 shows relation between the frequency and the amplitude of the diaphragm when a volume expansion member is not housed (Comparative Example 5). Characteristic curve 52 shows relation between the frequency and the amplitude of the diaphragm when an activated carbon elastic sheet is used as the volume expansion member (Comparative Example 3). Characteristic curve 53 shows relation between the frequency and the amplitude of the diaphragm when felt is used as the volume expansion member (Comparative Example 4). Characteristic curve 54 shows relation between the frequency and the amplitude of the diaphragm when elastic sheet 24 is used as the volume expansion member (Example 2).

As shown in FIG. 6, an amplitude of the diaphragm when elastic sheet 24 is used in a frequency in a low sound range of 1000 Hz or less is the largest. That is to say, the diaphragm of speaker system 21 when elastic sheet 24 is used can vibrate at a large amplitude in the frequency of in a low sound range, sound in a low sound range can be played back beautifully.

Figure 7:
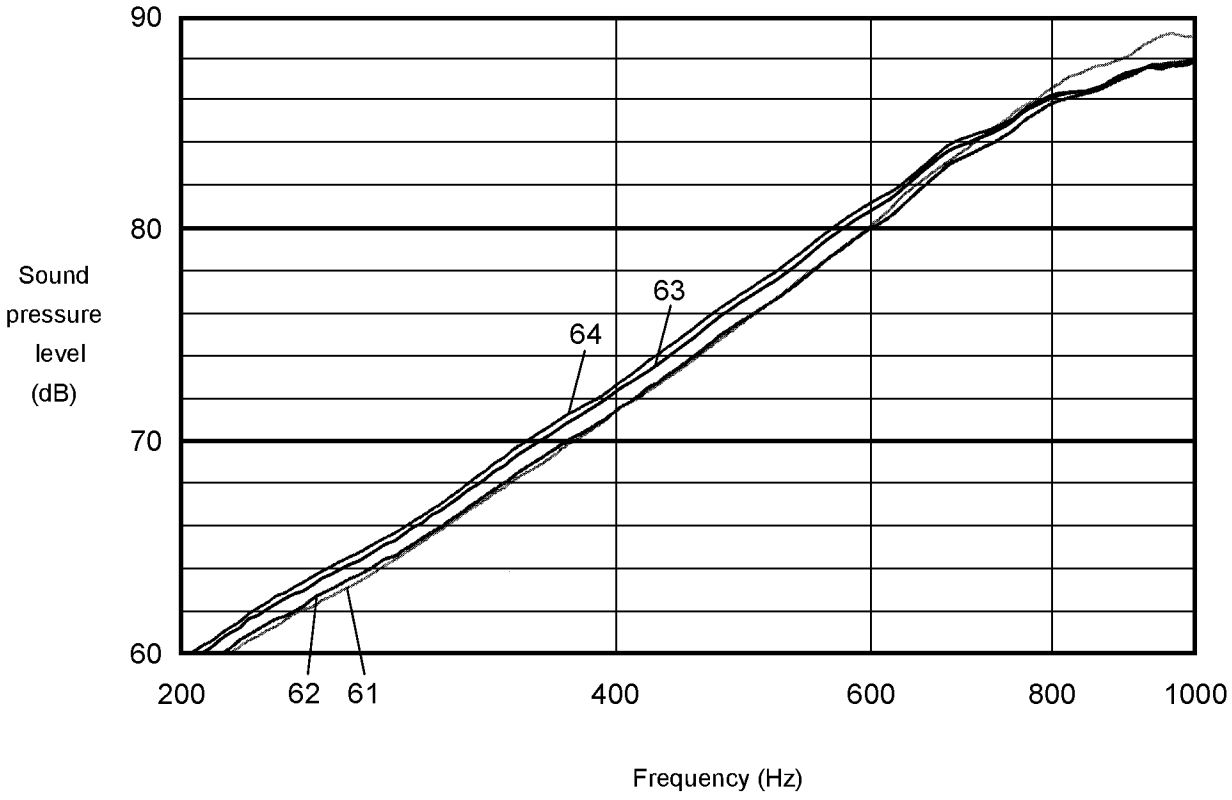
FIG. 7 is a characteristic diagram showing a sound pressure frequency of the speaker system in accordance with this exemplary embodiment.

FIG. 7 is a characteristic diagram showing a sound pressure frequency characteristic diagram of speaker system 21 in accordance with this exemplary embodiment. FIG. 7 shows sound pressure frequency characteristics of the speaker systems of Example 2 and Comparative Examples 3, 4, and 5. The abscissa shows the frequency, and the ordinate shows the sound pressure level. Characteristic curve 61 shows relation between a frequency and a sound pressure frequency when the volume expansion member is not used (Comparative Example 5). Characteristic curve 62 shows relation between a frequency and a sound pressure frequency when an activated carbon elastic sheet is used (Comparative Example 3). Characteristic curve 63 shows relation between a frequency and a sound pressure frequency when felt is used as the volume expansion member (Comparative Example 4). Characteristic curve 64 shows relation between a frequency and a sound pressure frequency when elastic sheet 24 is used as the volume expansion member (Example 2).

As shown in FIG. 7, the sound pressure frequency characteristics of speaker system 21 when elastic sheet 24 is used is the most preferable in the frequency in a low sound range of 1000 Hz or less. Herein, sound pressure levels of Example 2 and Comparative Examples 3, 4, and 5 at 300 Hz and 500 Hz are shown in Table 1. Note here that in general, a frequency of a male voice is 300 Hz to 550 Hz. Furthermore, a frequency of an average speaking voice of a man is 500 Hz.

TABLE 1

| Volume expansion member (50 mg/cm$^3$) | Sound pressure level (dB) 300 Hz | 500 Hz |
|---|---|---|
| Elastic sheet (Example 2) | 67.16 | 77.52 |
| Felt (Comparative Example 4) | 66.86 | 77.13 |
| Activated carbon (Comparative Example 3) | 66.09 | 76.23 |
| Nothing (Comparative Example 5) | 65.93 | 76.19 |

As mentioned above, packing of elastic sheet 24 in enclosure 22 allows an excellent sound in a low sound range to be played back even when enclosure 22 is small.

When elastic sheet 24 is packed in housing space 22B, it is preferable that elastic sheet 24 is sandwiched and held between at least two facing wall surfaces among wall surfaces. That is to say, it is preferable that elastic sheet 24 is sandwiched and held between at least two inner walls of enclosure 22. This configuration can suppress generation of a gap between elastic sheet 24 and wall surface 25. Therefore, elastic sheet 24 can be held in housing space 22B. Furthermore, it is possible to suppress entering of scraps of first fiber 24A and second fiber 24E generated from elastic sheet 24 into speaker unit 23. Therefore, it is possible to suppress entering of first fibers 24A and second fibers 24E into the magnetic gap to prevent an operation of a voice coil.

It is preferable that elastic sheet 24 is compressed by at least two facing surfaces among wall surfaces 25. That is to say, it is preferable that elastic sheet 24 is compressed by at least two inner walls of enclosure 22. With this configuration, it is possible to adjust the amount of elastic sheet 24 packed in enclosure 22, and to set elastic sheet 24 in enclosure 22 at appropriate weight. Furthermore, it is possible to further suppress entering of scraps of first fiber 24A and second fiber 24E generated from elastic sheet 24 into speaker unit 23. Furthermore, since elastic sheet 24 can be held in housing space 22B, movement of elastic sheet 24 can be suppressed.

Thus, when elastic sheet 24 is compressed and packed in enclosure 22, the weight per unit volume of elastic sheet 24 in a non-compressed state is smaller than the weight of elastic sheet 24 in a state packed in enclosure 22. Herein, it is preferable that the weight per unit volume of elastic sheet 24 in a non-compressed state is 10 mg/cm$^3$ or more and 55 mg/cm$^3$ or less. For example, when elastic sheet 24 whose weight per unit volume in a non-compressed state is 10 mg/cm$^3$ is used, elastic sheet 24 in a state packed in enclosure 22 is compressed to about one-fifth of the volume.

However, when the content of second fiber 24E is small, when elastic sheet 24 is compressed and packed in a housing space, compression of elastic sheet 24 causes second fiber 24E to collapse. That is to say, elastic sheet 24 is not restored to the volume before compression. Thus, it is preferable that elastic sheet 24 includes second fiber 24E to such a degree that does not exceed the limit of elasticity by the compression of elastic sheet 24. With this configuration, even when elastic sheet 24 is compressed to a predetermined volume and packed in housing space 22B, as shown in FIG. 1, elastic sheet 24 is brought into contact with wall surface 25.

Figure 8:
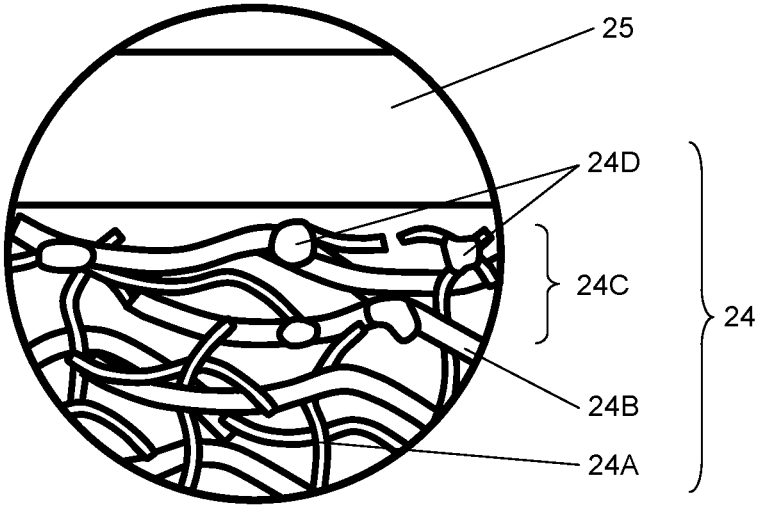
FIG. 8 is a conceptual diagram of a cut portion of an elastic sheet in accordance with this exemplary embodiment.

FIG. 8 is a conceptual diagram of cut portion 24C of elastic sheet 24 in accordance with this exemplary embodiment. When elastic sheet 24 is produced by cutting a large elastic sheet and packed in enclosure 22, elastic sheet 24 may include cut portion 24C on the surface thereof. When a large elastic sheet is cut, chips may remain inside elastic sheet 24. Herein, as shown in FIGS. 1 and 8, it is preferable that cut portion 24C is in contact with wall surface 25. This configuration can suppress generation of a gap between cut portion 24C and wall surface 25. Therefore, it is possible to suppress entering of the chips remaining in elastic sheet 24 into speaker unit 23.

Note here that it is preferable that, in elastic sheet 24, cut portion 24C is not formed on the surface that is in contact with air-permeable portion 22D shown in FIG. 1. In other words, it is preferable that, in elastic sheet 24, the surface in contact with air-permeable portion 22D are formed in a step before a large elastic sheet is cut. This configuration makes it possible to suppress remaining of fiber chips on the surface that is in contact with air-permeable portion 22D in elastic sheet 24.

It is further preferable that cut portion 24C includes fused portions 24D between first fibers 24A, between second fibers 24E, or between first fiber 24A and second fiber 24E. Herein, fused portion 24D is a portion in which first fibers 24A, second fibers 24E, or first fiber 24A and second fiber 24E are fused to each other, respectively. Therefore, generation of chips in cut portion 24C is suppressed. Accordingly, it is preferable that both first fiber 24A and second fiber 24E use a thermoplastic resin. Furthermore, it is preferable that elastic sheet 24 is cut by a cutting method accompanying heat, or a cutting method with heat. With this configuration, in cut portion 24C, first fibers 24A or second fibers 24E are melted and fused to each other. Thus, elastic sheet 24 may be cut, for example, by laser beam machining.

Figure 9:
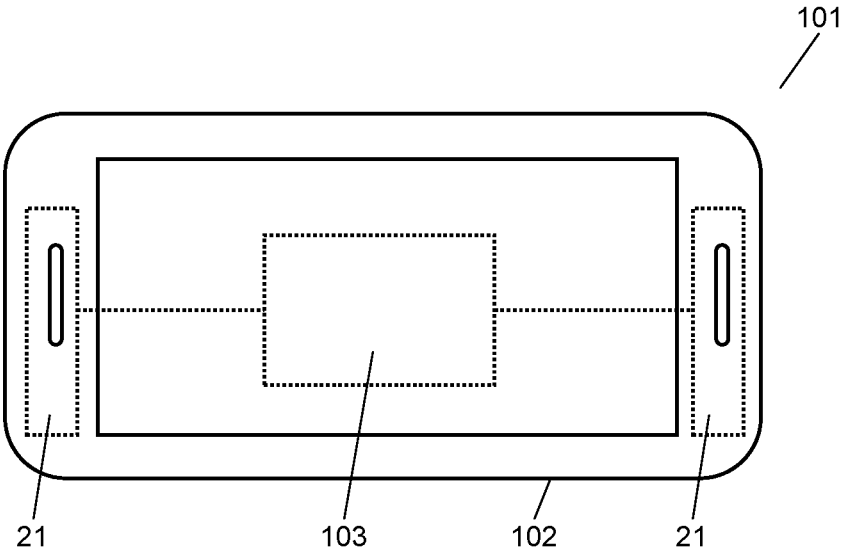
FIG. 9 is a conceptual diagram of an electronic device in accordance with this exemplary embodiment.

Next, electronic device 101 is described with reference to a drawing. FIG. 9 is a conceptual diagram of electronic device 101 in accordance with this exemplary embodiment. Examples of electronic device 101 include portable devices such as a tablet terminal, a smartphone, and portable telephone. Note here that electronic device 101 is not necessarily limited to portable devices, and it may be personal computer, television, radio, radio-cassette, and the like. Electronic device 101 includes case 102, processing circuit 103, and speaker system 21. Processing circuit 103 and speaker system 21 are housed in case 102. Furthermore, an output terminal of processing circuit 103 is electrically connected to speaker system 21. Processing circuit 103 outputs, for example, an audio signal. Then, the audio signal is electrically supplied to terminal 23A shown in FIG. 1. Thereby, a sound is output from speaker system 21. Processing circuit 103 is, for example, an amplifier section. Note here that processing circuit 103 may further include a reproduce unit of a sound source.

Use of speaker system 21 of the present disclosure can reduce electronic device 101. Furthermore, electronic device 101 can reproduce a sound in an excellent low sound range.

INDUSTRIAL APPLICABILITY

A speaker system of the present disclosure is small in size and has an effect capable of playing back a sound in an excellent low sound range. The speaker system is useful in use for small electronic devices and the like.

The invention claimed is:

1. A speaker system comprising:

an enclosure;

a speaker unit disposed in the enclosure; and an elastic sheet disposed in the enclosure and including:

a first fiber made of a thermoplastic resin, and a second fiber made of a resin, entangled with the first fiber and being thicker than the first fiber, wherein a diameter of the first fiber is 0.3 μm or more and 4 μm or less, a diameter of the second fiber is 20 μm or more and 30 μm or less, weight per unit volume of the elastic sheet is 30 mg/cm$^3$ or more and 60 mg/cm$^3$ or less, and the elastic sheet is compressed by the at least two inner walls of the enclosure.

2. The speaker system of claim 1, wherein the enclosure includes housing space and speaker space, the elastic sheet is disposed in the housing space, and the speaker unit is disposed in the speaker space.

3. The speaker system of claim 2, wherein the housing space and the speaker space are linked to each other via an air-permeable portion.

4. The speaker system of claim 2, wherein the speaker space has a sound emitting hole.

5. The speaker system of claim 1, wherein the elastic sheet has a cut portion that is in contact with an inner wall of the enclosure.

6. The speaker system of claim 1, wherein the elastic sheet includes a fused portion in which the first fiber and the second fiber are fused to each other.

7. The speaker system of claim 1, wherein the first fiber and the second fiber is a thermoplastic resin.

8. A speaker system comprising:

an enclosure;

a speaker unit disposed in the enclosure; and an elastic sheet disposed in the enclosure and including:

a first fiber made of a thermoplastic resin, and a third fiber made of a resin, entangled with the first fiber, and having a higher tensile modulus of elasticity than a tensile modulus of elasticity of the first fiber, wherein a diameter of the first fiber is 0.3 μm or more and 4 μm or less, a diameter of the third fiber is 20 μm or more and 30 μm or less, weight per unit volume of the elastic sheet is 30 mg/cm$^3$ or more and 60 mg/cm$^3$ or less, and the elastic sheet is compressed by the at least two inner walls of the enclosure.

9. An electronic device comprising:

a case;

the speaker system as defined in claim 1, housed in the case; and a processing circuit electrically connected to the speaker system.

10. The speaker system of claim 1, wherein weight per unit volume of the elastic sheet in a non-compressed state is 10 mg/cm$^3$ or more and 55 mg/cm$^3$ or less.

11. The speaker system of claim 1, wherein:

the elastic sheet has a cut portion that is in contact with an inner wall of the enclosure, and the elastic sheet includes a fused portion in which the first fiber and the second fiber are fused to each other.

12. The speaker system of claim 1, wherein the thermoplastic resin is polypropylene.

* * * * *